US009316971B2

(12) United States Patent
Hase et al.

(10) Patent No.: US 9,316,971 B2
(45) Date of Patent: Apr. 19, 2016

(54) IMAGE FORMING METHOD FOR FORMING TONER IMAGE ON RECORDING MEDIUM

(71) Applicants: Takamasa Hase, Tokyo (JP); Tadashi Ogawa, Tokyo (JP); Takeshi Uchitani, Kanagawa (JP); Satoshi Ueno, Tokyo (JP); Teppei Kawata, Kanagawa (JP); Kazuya Saito, Kanagawa (JP); Shuutaroh Yuasa, Kanagawa (JP); Kensuke Yamaji, Kanagawa (JP)

(72) Inventors: Takamasa Hase, Tokyo (JP); Tadashi Ogawa, Tokyo (JP); Takeshi Uchitani, Kanagawa (JP); Satoshi Ueno, Tokyo (JP); Teppei Kawata, Kanagawa (JP); Kazuya Saito, Kanagawa (JP); Shuutaroh Yuasa, Kanagawa (JP); Kensuke Yamaji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/339,150

(22) Filed: Jul. 23, 2014

(65) Prior Publication Data

US 2014/0334838 A1 Nov. 13, 2014

Related U.S. Application Data

(62) Division of application No. 13/280,946, filed on Oct. 25, 2011, now Pat. No. 8,811,843.

(30) Foreign Application Priority Data

Nov. 1, 2010 (JP) ..... 2010-244965

(51) Int. Cl.
*G03G 15/00* (2006.01)
*G03G 15/20* (2006.01)

(52) U.S. Cl.
CPC ..... *G03G 15/205* (2013.01); *G03G 15/5004* (2013.01)

(58) Field of Classification Search
CPC ..... G03G 15/5004; G03G 15/205
USPC ..... 399/69–70
See application file for complete search history.

(56) References Cited

U.S. PATENT DOCUMENTS 5,714,736 A 2/1998 Yoneda et al.
6,175,699 B1 * 1/2001 Kato et al. ..... 399/69

(Continued)

FOREIGN PATENT DOCUMENTS

JP 9-197862 A 7/1997
JP 2002-174979 6/2002

(Continued)

OTHER PUBLICATIONS

Office Action issued on Jul. 22, 2014, in Japanese Patent Application No. 2010-244965.

*Primary Examiner* — David Gray
*Assistant Examiner* — Andrew V Do
(74) *Attorney, Agent, or Firm* — Oblon, McClelland, Maier & Neustadt, L.L.P.

(57) ABSTRACT

A method for forming a toner image on a recording medium includes receiving a job, rotating a pressing rotary body in a predetermined direction of rotation, rotating a flexible endless belt disposed opposite the pressing rotary body to form a nip therebetween, turning on a belt heater disposed opposite to an inner circumferential surface of the flexible endless belt, conveying the recording medium bearing the toner image through the nip, turning off the belt heater for a predetermined first time period after the recording medium is discharged from the nip while the flexible endless belt and the pressing rotary body rotate, stopping the flexible endless belt and the pressing rotary body, turning on the belt heater when a predetermined second time period elapses after stopping the flexible endless belt and the pressing rotary body, and turning off the belt heater.

8 Claims, 11 Drawing Sheets

(56) References Cited

U.S. PATENT DOCUMENTS

| | | | | |
|---|---|---|---|---|
| 7,266,336 | B2 | 9/2007 | Ueno et al. | |
| 7,450,872 | B2 | 11/2008 | Ueno et al. | |
| 7,491,917 | B2 | 2/2009 | Ueno | |
| 7,509,085 | B2 | 3/2009 | Yoshinaga et al. | |
| 7,546,049 | B2 | 6/2009 | Ehara et al. | |
| 7,672,605 | B2 | 3/2010 | Kayahara et al. | |
| 7,693,439 | B2 | 4/2010 | Seo et al. | |
| 7,715,774 | B2 | 5/2010 | Ueno | |
| 7,734,208 | B2 | 6/2010 | Seo et al. | |
| 7,778,581 | B2 | 8/2010 | Seo et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 7,817,952 | B2 | 10/2010 | Seo et al. | |
| 7,885,590 | B2 | 2/2011 | Seo et al. | |
| 7,925,177 | B2 | 4/2011 | Ishii et al. | |
| 7,983,582 | B2 | 7/2011 | Hase | |
| 8,014,711 | B2 | 9/2011 | Ito et al. | |
| 8,682,192 | B2 | 3/2014 | Ikebuchi et al. | |
| 2006/0088326 | A1 * | 4/2006 | Nakayama | 399/69 |
| 2007/0014600 | A1 | 1/2007 | Ishii et al. | |
| 2007/0280754 | A1 | 12/2007 | Ogawa et al. | |
| 2009/0148205 | A1 | 6/2009 | Seo et al. | |
| 2009/0245897 | A1 | 10/2009 | Seo et al. | |
| 2010/0014903 | A1 | 1/2010 | Seto et al. | |
| 2010/0061753 | A1 | 3/2010 | Hase | |
| 2010/0158553 | A1 | 6/2010 | Ueno | |
| 2010/0232844 | A1 | 9/2010 | Saito et al. | |
| 2010/0239292 | A1 | 9/2010 | Fujita et al. | |
| 2010/0303521 | A1 | 12/2010 | Ogawa et al. | |
| 2011/0026988 | A1 | 2/2011 | Yoshikawa et al. | |
| 2011/0044734 | A1 | 2/2011 | Shimokawa et al. | |
| 2011/0052237 | A1 | 3/2011 | Yoshikawa et al. | |
| 2011/0052277 | A1 | 3/2011 | Ueno et al. | |
| 2011/0058862 | A1 | 3/2011 | Yamaguchi et al. | |
| 2011/0058863 | A1 | 3/2011 | Shinshi et al. | |
| 2011/0064443 | A1 | 3/2011 | Iwaya et al. | |
| 2011/0064450 | A1 | 3/2011 | Ishii et al. | |
| 2011/0064490 | A1 | 3/2011 | Imada et al. | |
| 2011/0064502 | A1 | 3/2011 | Hase et al. | |
| 2011/0085832 | A1 | 4/2011 | Hasegawa et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0176821 | A1 | 7/2011 | Hase | |
| 2011/0176822 | A1 | 7/2011 | Ishii et al. | |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0217056 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222876 | A1 | 9/2011 | Yuasa et al. | |
| 2011/0222926 | A1 | 9/2011 | Ueno et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229161 | A1 | 9/2011 | Ueno et al. | |
| 2011/0229162 | A1 | 9/2011 | Ogawa et al. | |
| 2011/0229178 | A1 | 9/2011 | Ogawa et al. | |
| 2011/0229180 | A1 | 9/2011 | Saito | |
| 2011/0229181 | A1 | 9/2011 | Iwaya et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0229236 | A1 | 9/2011 | Ehara et al. | |

FOREIGN PATENT DOCUMENTS

| | | |
|---|---|---|
| JP | 2002-357980 | 12/2002 |
| JP | 2003-302864 | 10/2003 |
| JP | 2004-102104 | 4/2004 |
| JP | 2005-173445 A | 6/2005 |
| JP | 2005-338244 | 12/2005 |
| JP | 2009-229861 A | 10/2009 |

* cited by examiner

IMAGE FORMING METHOD FOR FORMING TONER IMAGE ON RECORDING MEDIUM

CROSS-REFERENCE TO RELATED APPLICATIONS

This patent application is a Divisional Application of U.S. application Ser. No. 13/280,946, filed Oct. 25, 2011, which claims priority pursuant to 35 U.S.C. §119 to Japanese Patent Application No. 2010-244965, filed on Nov. 1, 2010, the entire contents of all of which are incorporated herein by reference.

FIELD OF THE INVENTION

Exemplary aspects of the present invention relate to an image forming apparatus and a method for forming a toner image on a recording medium, and more particularly, to an image forming apparatus for forming a toner image on a recording medium and a method used by the image forming apparatus.

BACKGROUND OF THE INVENTION

Related-art image forming apparatuses, such as copiers, facsimile machines, printers, or multifunction printers, having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ a fixing roller and a pressing roller pressed against the fixing roller to form a nip therebetween through which the recording medium bearing the toner image passes. The fixing roller and the pressing roller are heated by a fixing roller heater and a pressing roller heater disposed inside or outside the fixing roller and the pressing roller, respectively. As the recording medium bearing the toner image passes through the nip, the fixing roller heated by the fixing roller heater and the pressing roller heated by the pressing roller heater together apply heat and pressure to the recording medium, thus melting and fixing the toner image on the recording medium.

Such fixing device may enter a standby mode after the recording medium bearing the fixed toner image is discharged from the nip, in which at least one of the fixing roller heater and the pressing roller heater is turned on for a predetermined time period (e.g., 60 seconds) so that the fixing roller and the pressing roller are heated to a desired fixing temperature quickly upon receipt of the next job. After the predetermined time period elapses in the standby mode without receiving the next job, the at least one of the fixing roller heater and the pressing roller heater is turned off so that neither the fixing roller heater nor the pressing roller heater heats the fixing roller and the pressing roller.

However, in a case where the fixing roller and the pressing roller should be turned off immediately after the previous job is finished, for example, if the fixing device does not receive the next job within the predetermined period of time, power is wasted for keeping one of the heaters on throughout the standby mode.

To address this problem, two control methods are proposed. The first method is to turn off the heater before the last recording medium of the job is discharged from the nip. This method is employed to prevent overheating of the fixing roller after the job due to absence of the recording medium that draws heat from the fixing roller. Accordingly, this method is effective with a heater disposed inside the fixing roller because heat conduction from the inner surface to the outer surface of the fixing roller overheats the fixing roller. That is, in this method, the heater is turned off for a substantial period of time even in the standby mode to prevent overheating of the fixing roller, resulting in power saving.

By contrast, if the fixing device has an induction heater disposed outside the fixing roller, the temperature of the outer surface of the fixing roller is higher than that of the inner surface of the fixing roller, causing no heat conduction from the inner surface to the outer surface thereof that overheats the fixing roller. Accordingly, the induction heater, which is turned off before the recording medium of the job is discharged from the nip, needs to be turned on again immediately after the fixing device enters the standby mode, wasting power.

The second method is to lower the target temperature of the fixing roller and the pressing roller after the job is finished. For example, a target temperature of the fixing roller in the standby mode is lower than a target temperature during the job. Similarly, a target temperature of the pressing roller in the standby mode is lower than a target temperature during the job, with the temperature differential therebetween greater than that between the target temperatures of the fixing roller. However, with this method, the heaters are not turned off in the standby mode. As a result, power saving is insufficient.

BRIEF SUMMARY OF THE INVENTION

This specification describes below an improved image forming apparatus. In one exemplary embodiment of the present invention, the image forming apparatus performs a copier job and a printer job and includes a control panel to receive the copier job; a reader to read an image on an original document to generate image data in the copier job; an image forming device to form a toner image on a recording medium according to the image data generated by the reader in the copier job or image data sent from an external device in the printer job; a media tray to contain the recording medium to be sent to the image forming device; and a fixing device to fix the toner image formed by the image forming device on the recording medium. The fixing device includes a fixing rotary body rotatable in a predetermined direction of rotation; a pressing rotary body rotatable in a direction counter to the direction of rotation of the fixing rotary body and pressed against the fixing rotary body to form a nip therebetween through which the recording medium bearing the toner image passes; a fixing rotary body heater disposed opposite the fixing rotary body to heat the fixing rotary body; and a pressing rotary body heater disposed inside the pressing rotary body to heat the pressing rotary body. The image forming apparatus further includes a controller operatively connected to the fixing rotary body heater and the pressing rotary body heater to control the fixing rotary body heater and the pressing rotary body heater. The controller activates a standby mode after the copier job and the printer job are finished in which the controller turns off at least the fixing rotary body heater and a subsequent off mode in which the controller turns off the pressing rotary body heater and the fixing rotary body heater, and identifies which of the copier job and the printer job is to be performed to turn on and off the pressing rotary body heater in the standby mode according to the identified job.

This specification further describes an improved method for forming a toner image on a recording medium. In one exemplary embodiment, the method includes receiving a job; rotating a pressing rotary body in a predetermined direction of rotation; rotating a flexible endless belt disposed opposite the pressing rotary body to form a nip therebetween in a direction counter to the direction of rotation of the pressing rotary body; turning on a belt heater disposed opposite an inner circumferential surface of the flexible endless belt to heat the flexible endless belt; conveying the recording medium bearing the toner image through the nip; turning off the belt heater for a predetermined first time period after the recording medium is discharged from the nip while the flexible endless belt and the pressing rotary body rotate; stopping the flexible endless belt and the pressing rotary body; turning on the belt heater when a predetermined second time period elapses after stopping the flexible endless belt and the pressing rotary body; and turning off the belt heater.

This specification further describes an improved method for forming a toner image on a recording medium. In one exemplary embodiment, the method includes receiving a job; rotating a pressing rotary body in a predetermined direction of rotation; rotating a fixing rotary body disposed opposite the pressing rotary body in a direction counter to the direction of rotation of the pressing rotary body; turning on a pressing rotary body heater to heat the pressing rotary body; turning on a fixing rotary body heater to heat the fixing rotary body; conveying the recording medium bearing the toner image between the pressing rotary body and the fixing rotary body; turning off the fixing rotary body heater and the pressing rotary body heater; stopping the fixing rotary body and the pressing rotary body; turning on the pressing rotary body heater when a predetermined first time period elapses after stopping the fixing rotary body and the pressing rotary body; and turning off the pressing rotary body heater when a predetermined second time period elapses after turning on the pressing rotary body heater.

BRIEF DESCRIPTION OF THE SEVERAL VIEWS OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
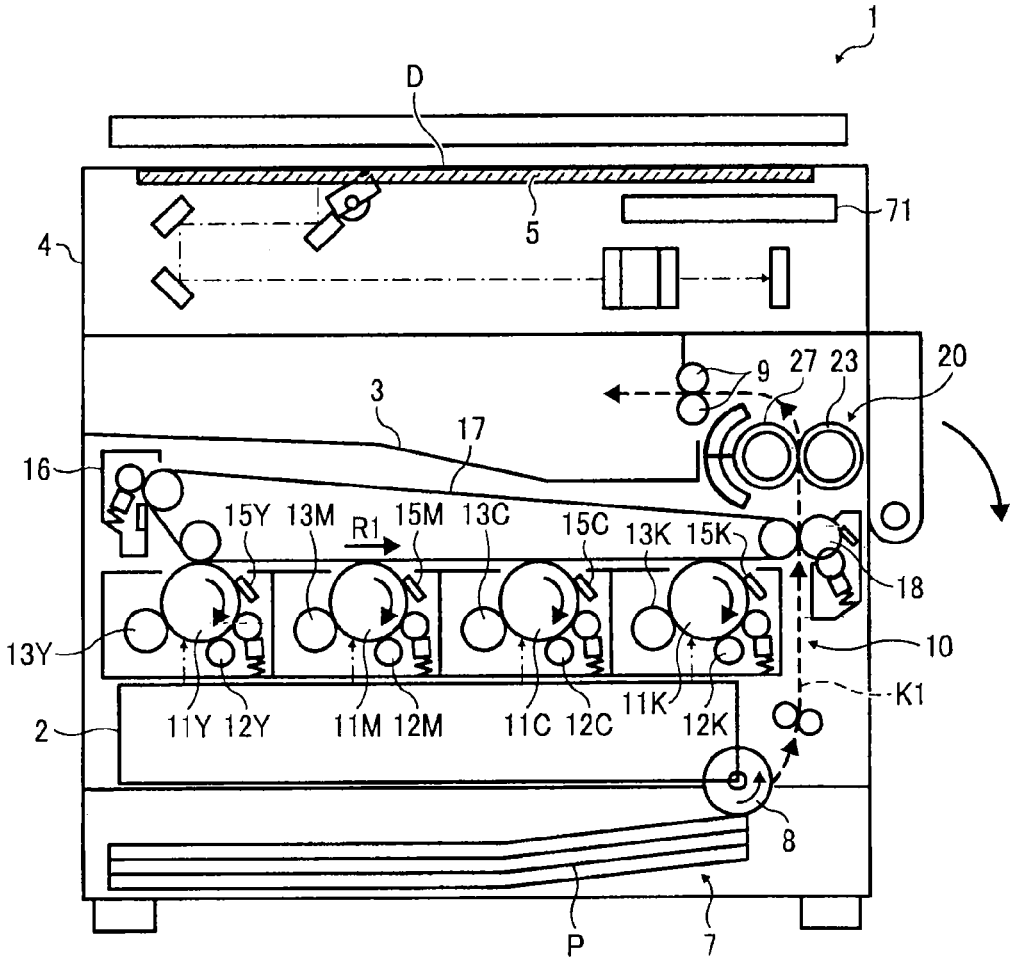
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic sectional view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this example embodiment, the image forming apparatus 1 is a multifunction printer for forming a monochrome image and a color image on a recording medium by electrophotography.

Referring to FIG. 1, the following describes the structure of the image forming apparatus 1.

As illustrated in FIG. 1, the image forming apparatus 1 includes an original document reader 4 disposed in an upper portion of the image forming apparatus 1 and including an exposure glass 5. When a user inputs a copier job by using a control panel 71 disposed atop the image forming apparatus 1, the original document reader 4 reads an image on an original document D placed on the exposure glass 5 and generates image data. Below the original document reader 4 is an image forming device 10 that includes a writer 2, photoconductive drums 11Y, 11M, 11C, and 11K, chargers 12Y, 12M, 12C, and 12K, development devices 13Y, 13M, 13C, and 13K, cleaners 15Y, 15M, 15C, and 15K, an intermediate transfer belt cleaner 16, an intermediate transfer belt 17, and a second transfer roller 18. For example, in a lower portion of the image forming apparatus 1 is the writer 2 that emits laser beams onto the photoconductive drums 11Y, 11M, 11C, and 11K surrounded by the chargers 12Y, 12M, 12C, and 12K, the development devices 13Y, 13M, 13C, and 13K, and the cleaners 15Y, 15M, 15C, and 15K, respectively. Specifically, the writer 2 emits the laser beams onto the photoconductive drums 11Y, 11M, 11C, and 11K charged by the chargers 12Y, 12M, 12C, and 12K according to the image data sent from the original document reader 4, thus forming electrostatic latent images on the photoconductive drums 11Y, 11M, 11C, and 11K. The development devices 13Y, 13M, 13C, and 13K visualize the electrostatic latent images formed on the photoconductive drums 11Y, 11M, 11C, and 11K with yellow, magenta, cyan, and black toners into yellow, magenta, cyan, and black toner images, respectively. The photoconductive drums 11Y, 11M, 11C, and 11K are disposed opposite transfer bias rollers that transfer the yellow, magenta, cyan, and black toner images from the photoconductive drums 11Y, 11M, 11C, and 11K onto the intermediate transfer belt 17 in such a manner that the yellow, magenta, cyan, and black toner images are superimposed on the same position on the intermediate transfer belt 17, thus producing a color toner image on the intermediate transfer belt 17. After the transfer of the yellow, magenta, cyan, and black toner images, the cleaners 15Y, 15M, 15C, and 15K collect residual toners from the photoconductive drums 11Y, 11M, 11C, and 11K, respectively. Specifically, the intermediate transfer belt 17, looped over the transfer bias rollers and other rollers including a driving roller, rotates in a rotation direction R1. Below the writer 2 is a paper tray 7 serving as a media tray that contains a plurality of recording media P (e.g., transfer sheets). Above the paper tray 7 is a feed roller 8 that picks up and feeds a recording medium P from the paper tray 7 to a registration roller pair that feeds the recording medium P to a second transfer nip formed between the intermediate transfer belt 17 and the second transfer roller 18 at a proper time. As the recording medium P is conveyed through the second transfer nip, the second transfer roller 18 transfers the color toner image from the intermediate transfer belt 17 onto the recording medium P.

After the transfer of the color toner image from the intermediate transfer belt 17, the intermediate transfer belt cleaner 16 disposed opposite the intermediate transfer belt 17 cleans the intermediate transfer belt 17. Above the second transfer roller 18 is a fixing device 20 that fixes the color toner image on the recording medium P by heating the recording medium P by electromagnetic induction. Above the fixing device 20 is an output roller pair 9 that discharges the recording medium P bearing the fixed color toner image sent from the fixing device 20 onto an output tray 3.

Referring to FIG. 1, the following describes the operation of the image forming apparatus 1 having the above-described structure to form a color toner image on a recording medium P by using a copier function.

When the user inputs a copier job by using the control panel 71, the original document reader 4 optically reads an image on the original document D placed on the exposure glass 5. For example, a lamp of the original document reader 4 emits a light beam onto the original document D bearing the image. The light beam reflected by the original document D travels to a color sensor through mirrors and a lens, where the image is formed. The color sensor reads and separates the image into red, green, and blue images, and converts the images into electric image signals for red, green, and blue. Based on the respective electric image signals, an image processor of the original document reader 4 performs processing such as color conversion, color correction, and space frequency correction, thus producing yellow, magenta, cyan, and black image data.

Thereafter, the yellow, magenta, cyan, and black image data are sent to the writer 2. The writer 2 emits laser beams onto the photoconductive drums 11Y, 11M, 11C, and 11K according to the yellow, magenta, cyan, and black image data sent from the original document reader 4.

A detailed description is now given of five processes performed on the photoconductive drums 11Y, 11M, 11C, and 11K, that is, a charging process, an exposure process, a development process, a first transfer process, and a cleaning process.

The four photoconductive drums 11Y, 11M, 11C, and 11K rotate clockwise in FIG. 1. In the charging process, the chargers 12Y, 12M, 12C, and 12K, disposed opposite the photoconductive drums 11Y, 11M, 11C, and 11K, uniformly charge an outer circumferential surface of the respective photoconductive drums 11Y, 11M, 11C, and 11K, thus generating a charging potential on the respective photoconductive drums 11Y, 11M, 11C, and 11K. Thereafter, the charged outer circumferential surface of the respective photoconductive drums 11Y, 11M, 11C, and 11K reaches a position where it receives a laser beam.

In the exposure process, four light sources of the writer 2, disposed opposite the photoconductive drums 11Y, 11M, 11C, and 11K, emit laser beams according to the yellow, magenta, cyan, and black image data, respectively. The laser beams corresponding to the yellow, magenta, cyan, and black image data travel through different optical paths, respectively. For example, the laser beam corresponding to the yellow image data irradiates the leftmost photoconductive drum 11Y in FIG. 1. Specifically, a polygon mirror of the writer 2, which rotates at a high speed, causes the laser beam corresponding to the yellow image data to scan the charged surface of the photoconductive drum 11Y in an axial direction of the photoconductive drum 11Y, that is, a main scanning direction. Thus, an electrostatic latent image is formed on the surface of the photoconductive drum 11Y charged by the charger 12Y according to the yellow image data.

Similarly, the laser beam corresponding to the magenta image data irradiates the second photoconductive drum 11M from the left in FIG. 1, forming an electrostatic latent image according to the magenta image data. The laser beam corresponding to the cyan image data irradiates the third photoconductive drum 11C from the left in FIG. 1, forming an electrostatic latent image according to the cyan image data. The laser beam corresponding to the black image data irradiates the rightmost photoconductive drum 11K in FIG. 1, forming an electrostatic latent image according to the black image data.

Thereafter, the outer circumferential surface of the respective photoconductive drums 11Y, 11M, 11C, and 11K formed with the electrostatic latent images reaches a position where the photoconductive drums 11Y, 11M, 11C, and 11K are disposed opposite the development devices 13Y, 13M, 13C, and 13K, respectively. In the development process, the development devices 13Y, 13M, 13C, and 13K, disposed opposite the photoconductive drums 11Y, 11M, 11C, and 11K, supply yellow, magenta, cyan, and black toners to the electrostatic latent images formed on the photoconductive drums 11Y, 11M, 11C, and 11K, respectively, thus rendering the electrostatic latent images visible as yellow, magenta, cyan, and black toner images.

Thereafter, the outer circumferential surface of the respective photoconductive drums 11Y, 11M, 11C, and 11K formed with the yellow, magenta, cyan, and black toner images reaches a position where the photoconductive drums 11Y, 11M, 11C, and 11K are disposed opposite the intermediate transfer belt 17. The four transfer bias rollers are disposed opposite the four photoconductive drums 11Y, 11M, 11C, and 11K, respectively, via the intermediate transfer belt 17 in a state in which the transfer bias rollers contact an inner circumferential surface of the intermediate transfer belt 17. In the first transfer process, the transfer bias rollers transfer the yellow, magenta, cyan, and black toner images from the photoconductive drums 11Y, 11M, 11C, and 11K onto an outer circumferential surface of the intermediate transfer belt 17 successively in such a manner that the yellow, magenta, cyan, and black toner images are superimposed on the same position on the intermediate transfer belt 17, thus producing a color toner image on the intermediate transfer belt 17.

Thereafter, the outer circumferential surface of the respective photoconductive drums 11Y, 11M, 11C, and 11K that no longer carry the yellow, magenta, cyan, and black toner images reaches a position where the photoconductive drums 11Y, 11M, 11C, and 11K are disposed opposite the cleaners 15Y, 15M, 15C, and 15K, respectively. In the cleaning process, the cleaners 15Y, 15M, 15C, and 15K, disposed opposite the photoconductive drums 11Y, 11M, 11C, and 11K, collect residual toners not transferred and therefore remaining on the photoconductive drums 11Y, 11M, 11C, and 11K from the photoconductive drums 11Y, 11M, 11C, and 11K, respectively.

Thereafter, dischargers disposed opposite the photoconductive drums 11Y, 11M, 11C, and 11K discharge the outer circumferential surface of the respective photoconductive drums 11Y, 11M, 11C, and 11K, thus completing a series of processes performed on the photoconductive drums 11Y, 11M, 11C, and 11K.

A detailed description is now given of two processes performed on the intermediate transfer belt 17, that is, a second transfer process and a cleaning process.

The outer circumferential surface of the intermediate transfer belt 17 transferred with the color toner image reaches a position where it is disposed opposite the second transfer roller 18, that is, the second transfer nip. Specifically, the second transfer nip is created by the second transfer roller 18 and a second transfer backup roller that sandwich the intermediate transfer belt 17. As a recording medium P sent from the paper tray 7 passes through the second transfer nip, the color toner image formed on the intermediate transfer belt 17 is transferred onto the recording medium P in the second transfer process. After the transfer of the color toner image from the intermediate transfer belt 17, residual toner not transferred onto the recording medium P remains on the intermediate transfer belt 17.

Thereafter, the outer circumferential surface of the intermediate transfer belt 17 that no longer carries the color toner image reaches a position where it is disposed opposite the intermediate transfer belt cleaner 16. The intermediate transfer belt cleaner 16 collects the residual toner from the intermediate transfer belt 17 in the cleaning process, thus completing a series of processes performed on the intermediate transfer belt 17.

A detailed description is now given of two processes performed on the recording medium P, that is, the second transfer process described above and a fixing process.

The recording medium P is conveyed from the paper tray 7 disposed in the lower portion of the image forming apparatus 1 to the second transfer nip through a conveyance path K1 provided with the feed roller 8 and the registration roller pair. For example, the paper tray 7 contains a plurality of recording media P. As the feed roller 8 rotates counterclockwise in FIG. 1, the feed roller 8 feeds an uppermost recording medium P to the conveyance path K1.

The recording medium P conveyed to the conveyance path K1 is stopped temporarily by the registration roller pair at a nip formed between two rollers of the registration roller pair. When the registration roller pair resumes rotating, the registration roller pair feeds the recording medium P to the second transfer nip at a proper time for transferring the color toner image formed on the intermediate transfer belt 17 onto the recording medium P. Thus, a desired color toner image is transferred onto the recording medium P in the second transfer process described above.

Thereafter, the recording medium P bearing the color toner image is sent to the fixing device 20 where a fixing roller 27 and a pressing roller 23 apply heat and pressure to the recording medium P to fix the color toner image on the recording medium P in the fixing process. Then, the output roller pair 9 disposed downstream from the fixing device 20 in a conveyance direction of the recording medium P discharges the recording medium P bearing the fixed color toner image in a direction indicated by the broken line arrow onto the output tray 3, thus completing a series of processes for forming the color toner image on the recording medium P.

The image forming apparatus 1 can also form a toner image on a recording medium P by using a printer function. In this case, the original document reader 4 is not used. For example, the writer 2 emits laser beams onto the photoconductive drums 11Y, 11M, 11C, and 11K according to yellow, magenta, cyan, and black image data sent from an external device (e.g., a client computer). The processes thereafter are the same as the above-described processes performed by using the copier function.

Figure 2:
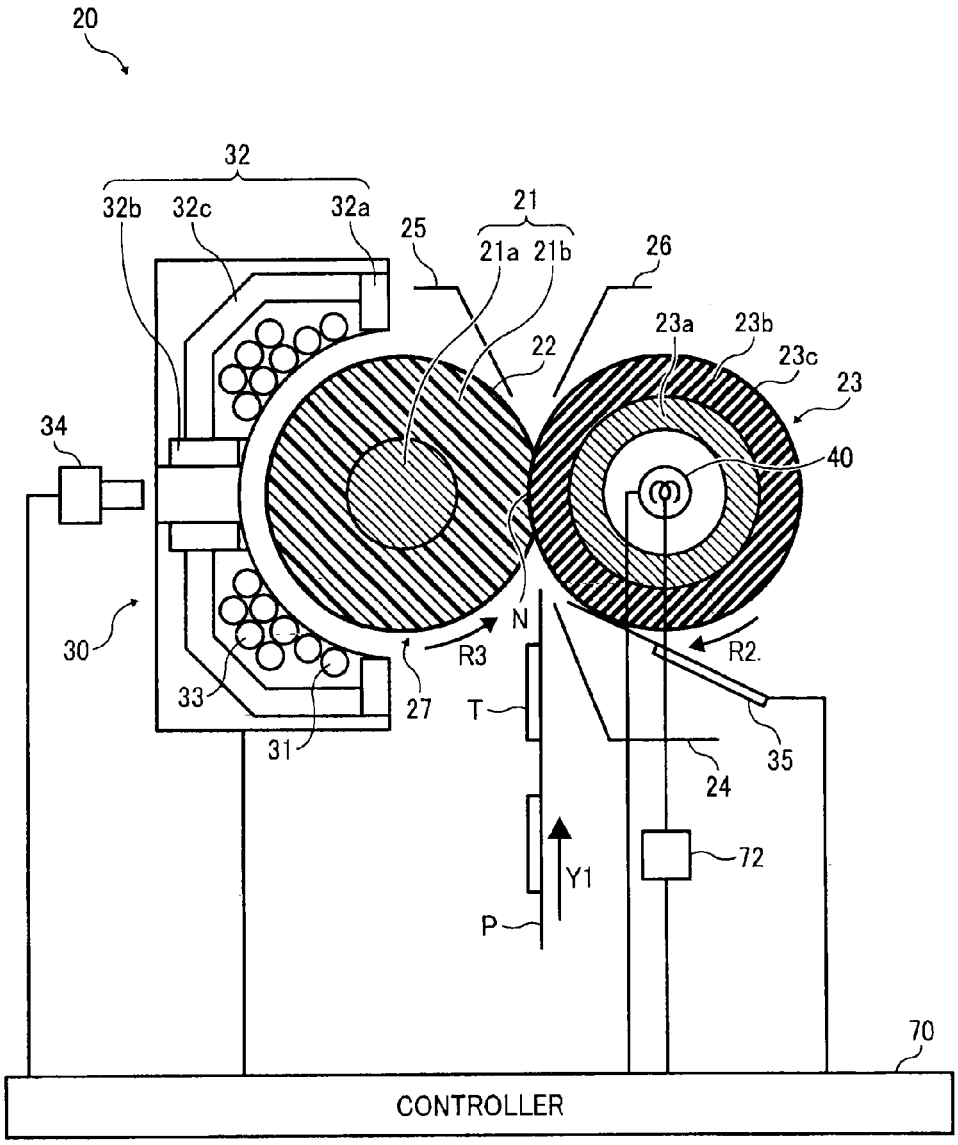
FIG. 2 is a vertical sectional view of a fixing device included in the image forming apparatus shown in FIG. 1.

Referring to FIG. 2, the following describes the structure and operation of the fixing device 20 installed in the image forming apparatus 1 described above. FIG. 2 is a vertical sectional view of the fixing device 20.

As illustrated in FIG. 2, the fixing device 20 (e.g., a fuser unit) includes the fixing roller 27 including a fixing roll 21 and a fixing sleeve 22 and serving as a fixing rotary body, the pressing roller 23 serving as a pressing rotary body, an induction heater 30 serving as a fixing rotary body heater, and a pressing roller heater 40 serving as a pressing rotary body heater.

The fixing sleeve 22 having an outer diameter of about 40 mm is constructed of a base layer, an elastic layer disposed on the base layer, and a release layer disposed on the elastic layer. The base layer having a thickness in a range of from about 30 micrometers to about 50 micrometers is made of magnetic metal such as iron, cobalt, nickel, or an alloy of these, for example.

The elastic layer having a thickness of about 150 micrometers is made of an elastic material such as silicone rubber, thus having a relatively smaller heat capacity. Accordingly, the fixing sleeve 22 applies heat and pressure to a recording medium P uniformly throughout an axial direction of the fixing roller 27, thus fixing a toner image T on the recording medium P properly.

The release layer is a tube made of a fluorine compound such as tetrafluoroethylene-perfluoroalkylvinylether copolymer (PFA) and coating the elastic layer with a thickness of about 50 micrometers. The release layer facilitates separation of toner of the toner image T on the recording medium P that directly contacts an outer circumferential surface of the fixing sleeve 22 from the fixing sleeve 22.

The fixing roll 21 having an outer diameter of about 40 mm is constructed of a cylindrical metal core 21*a* made of metal such as stainless steel and a heat resistant elastic layer 21*b* disposed on the metal core 21*a* and made of silicone foam. The elastic layer 21*b* has a thickness of about 9 mm and an epaxial Asker hardness in a range of from about 30 degrees to about 50 degrees. The fixing roll 21 contacts an inner circumferential surface of the fixing sleeve 22 to maintain a roller shape of the thin fixing sleeve 22.

The pressing roller 23 having an outer diameter of about 40 mm is constructed of a metal core 23*a* made of thermal conductive metal such as aluminum, copper, or the like, a heat resistant elastic layer 23*b* disposed on the metal core 23*a* and made of silicone rubber, and a release layer 23*c* disposed on the elastic layer 23*b*. The elastic layer 23*b* has a thickness of about 2 mm. The release layer 23*c* is a PFA tube coating the elastic layer 23*b* and having a thickness of about 50 micrometers. The pressing roller 23 is pressed against the fixing roll 21 via the fixing sleeve 22, forming a fixing nip N between the pressing roller 23 and the fixing roller 27 through which the recording medium P bearing the toner image T is conveyed.

The pressing roller heater 40 serving as a pressing rotary body heater is disposed inside the pressing roller 23. A contact thermistor 35 that contacts the pressing roller 23 detects a temperature of the pressing roller 23. The thermistor 35 is operatively connected to a controller 70, that is, a central processing unit (CPU) provided with a random-access memory (RAM) and a read-only memory (ROM), for example. The controller 70 is operatively connected to the pressing roller heater 40 to control the pressing roller heater 40 based on the temperature of the pressing roller 23 detected by the thermistor 35 to heat the pressing roller 23 to a desired temperature. For example, the pressing roller heater 40 may be a halogen heater, an infrared heater, or other thermal resistant body.

The induction heater 30 includes an exciting coil 31, a core portion 32, and a degaussing coil 33. The exciting coil 31 includes litz wire made of bundled thin wire wound around a coil guide that covers a part of the outer circumferential surface of the fixing sleeve 22 and extending in an axial direction of the fixing sleeve 22. The degaussing coil 33 and the exciting coil 31 are symmetric with respect to a line extending in the axial direction of the fixing sleeve 22 in such a manner that the degaussing coil 33 overlaps the exciting coil 31. The core portion 32 is made of a ferromagnet (e.g., ferrite) having a relative magnetic permeability of about 2,500. The core portion 32 includes a center core 32*b*, an arc core 32*c*, and a side core 32*a* to generate magnetic fluxes toward the fixing sleeve 22 effectively. The core portion 32 is disposed opposite the exciting coil 31 extending in the axial direction of the fixing sleeve 22. A thermopile 34 is disposed opposite the fixing roller 27 to detect a temperature of the outer circumferential surface of the fixing sleeve 22. The controller 70 operatively connected to the thermopile 34 controls the induction heater 30 based on the temperature of the fixing sleeve 22 detected by the thermopile 34 to heat the fixing sleeve 22 to a desired temperature.

Referring to FIG. 2, the following describes a fixing process performed by the fixing device 20 having the above-described structure.

As a motor 72 rotates the pressing roller 23 clockwise in FIG. 2 in a rotation direction R2, the rotating pressing roller 23 rotates the fixing sleeve 22 by friction counterclockwise in FIG. 2 in a rotation direction R3 counter to the rotation direction R2 of the pressing roller 23. By contrast, the fixing roll 21 that supports the fixing sleeve 22 receives a relatively smaller rotating force from the pressing roller 23. The induction heater 30 disposed opposite the fixing sleeve 22 generates a magnetic flux to heat the fixing sleeve 22.

For example, as a power supply supplies a high frequency alternating current in a range of from about 10 kHz to about 1 MHz, preferably in a range of from about 20 kHz to about 800 kHz, to the exciting coil 31, magnetic lines of force generate in proximity to the fixing sleeve 22 disposed opposite the exciting coil 31 in such a manner that a direction of the magnetic lines of force is alternately switched bidirectionally, thus generating an alternating magnetic field. The alternating magnetic field generates an eddy current in a heat generating layer contained in the base layer of the fixing sleeve 22, which causes the heat generating layer to generate Joule heat by its electric resistance. Thus, the fixing sleeve 22 is heated by induction heating of the base layer thereof.

As the outer circumferential surface of the fixing sleeve 22 heated by the induction heater 30 passes through the fixing nip N, the fixing sleeve 22 heats and melts the toner image T on the recording medium P conveyed through the fixing nip N.

For example, the recording medium P bearing the toner image T formed by the image forming processes described above is conveyed in a direction Y1 and enters the fixing nip N while guided by a guide plate 24 disposed upstream from the fixing nip N in the conveyance direction of the recording medium P. As the recording medium P bearing the toner image T passes through the fixing nip N, the fixing sleeve 22 heats the recording medium P and at the same time the pressing roller 23 applies pressure to the recording medium P, thus melting and fixing the toner image T on the recording medium P. Then, the recording medium P bearing the fixed toner image T is discharged from the fixing nip N while guided and separated from the fixing sleeve 22 by separation plates 25 and 26 disposed downstream from the fixing nip N in the conveyance direction of the recording medium P. Specifically, the separation plate 25 is disposed opposite the fixing sleeve 22 and the separation plate 26 is disposed opposite the pressing roller 23.

After the recording medium P bearing the fixed toner image T is discharged from the fixing nip N, the heated portion of the fixing sleeve 22 having passed through the fixing nip N and now cooled by the recording medium P returns to an opposed position where the fixing sleeve 22 is disposed opposite the induction heater 30.

It is to be noted that when a plurality of smaller recording media is conveyed through the fixing nip N continuously, a control circuit short-circuits a relay to cause the degaussing coil 33 to generate a magnetic field that offsets the magnetic field generated by the exciting coil 31. Accordingly, the magnetic field is decreased in a non-conveyance region on the fixing sleeve 22 where the smaller recording media are not conveyed and the degaussing coil 33 is disposed opposite the exciting coil 31. Consequently, the fixing sleeve 22 generates minimized Joule heat in the non-conveyance region thereon where heating of the fixing sleeve 22 is unnecessary.

Thus, a series of the above-described operations is repeated, completing the fixing process constituting a part of the image forming processes.

Referring to FIGS. 1 to 7, the following describes control processes for heating the fixing sleeve 22 and the pressing roller 23 having the above-described structure according to a first embodiment.

In the description below, a job defines a printer job performed by the image forming apparatus 1 by using a printer function thereof and a copier job performed by the image forming apparatus 1 by using a copier function thereof. The image forming apparatus 1 has an off mode, a standby mode, and a print preparation mode. The off mode defines a state in which the components installed in the image forming apparatus 1 including the fixing device 20 are turned off and the controller 70 is in a sleep mode. That is, power is supplied to neither the induction heater 30 nor the pressing roller heater 40. The standby mode is activated after a job is finished and prior to entering the off mode. The standby mode defines a state in which power is supplied to at least one of the induction heater 30 and the pressing roller heater 40 continually or intermittently while at least one of the fixing roller 27 and the pressing roller 23 is stopped or rotated intermittently, for example, rotated one cycle periodically, thus maintaining the temperature of the fixing roller 27 and the pressing roller 23 at a predetermined temperature. The print preparation mode is activated when at least one of the control panel 71, the reader 4, and the paper tray 7 is in operation. The print preparation mode defines a state in which power is supplied to at least one of the induction heater 30 and the pressing roller heater 40 continually or intermittently while at least one of the fixing roller 27 and the pressing roller 23 is rotated continually, thus maintaining the temperature of the fixing roller 27 and the pressing roller 23 at a predetermined temperature.

If a job received by the image forming apparatus 1 is a printer job for forming a toner image T on a recording medium P by using the printer function of the image forming apparatus 1, the off mode can be activated soon after the printer job is finished, that is, when about 10 seconds elapse after the printer job is finished, without degrading usability of the image forming apparatus 1. By contrast, if a job received by the image forming apparatus 1 is a copier job for forming a toner image T on a recording medium P by using the copier function of the image forming apparatus 1, the off mode cannot be activated soon after the copier job is finished or soon after the print preparation mode because it may degrade usability of the image forming apparatus 1 as described below. Accordingly, it is preferable to maintain the standby mode for a predetermined time period (e.g., about 60 seconds) after the copier job is finished so that the image forming apparatus 1 starts a next job immediately.

To improve usability of the image forming apparatus 1, the fixing device 20 includes the fixing rotary body (e.g., the fixing roller 27 including the fixing roll 21 and the fixing sleeve 22); the pressing rotary body (e.g., the pressing roller 23) pressed against the fixing rotary body; the fixing rotary body heater (e.g., the induction heater 30) that heats the heat generating layer (e.g., the elastic layer 21*b*) of the fixing roll 21 of the fixing roller 27 by electromagnetic induction; and the pressing rotary body heater (e.g., the pressing roller heater 40) disposed inside the pressing rotary body to heat the pressing rotary body. After a job is finished, the controller 70 activates the standby mode that turns on at least the pressing rotary body heater, and then activates the off mode that turns off the fixing rotary body heater and the pressing rotary body heater when a predetermined time period elapses after the job is finished. If a job is a printer job, the controller 70 turns off the pressing rotary body heater for a predetermined time period in the standby mode.

It is to be noted that, according to this exemplary embodiment, in the standby mode, power is not supplied to the fixing rotary body heater but is supplied to the pressing rotary body heater continually or intermittently, thus controlling the temperature of the fixing rotary body and the pressing rotary body. Alternatively, a limited amount of power may be supplied to the fixing rotary body and at the same time power may be supplied to the pressing rotary body continually or intermittently, thus controlling the temperature of both the fixing rotary body and the pressing rotary body.

Figure 3:
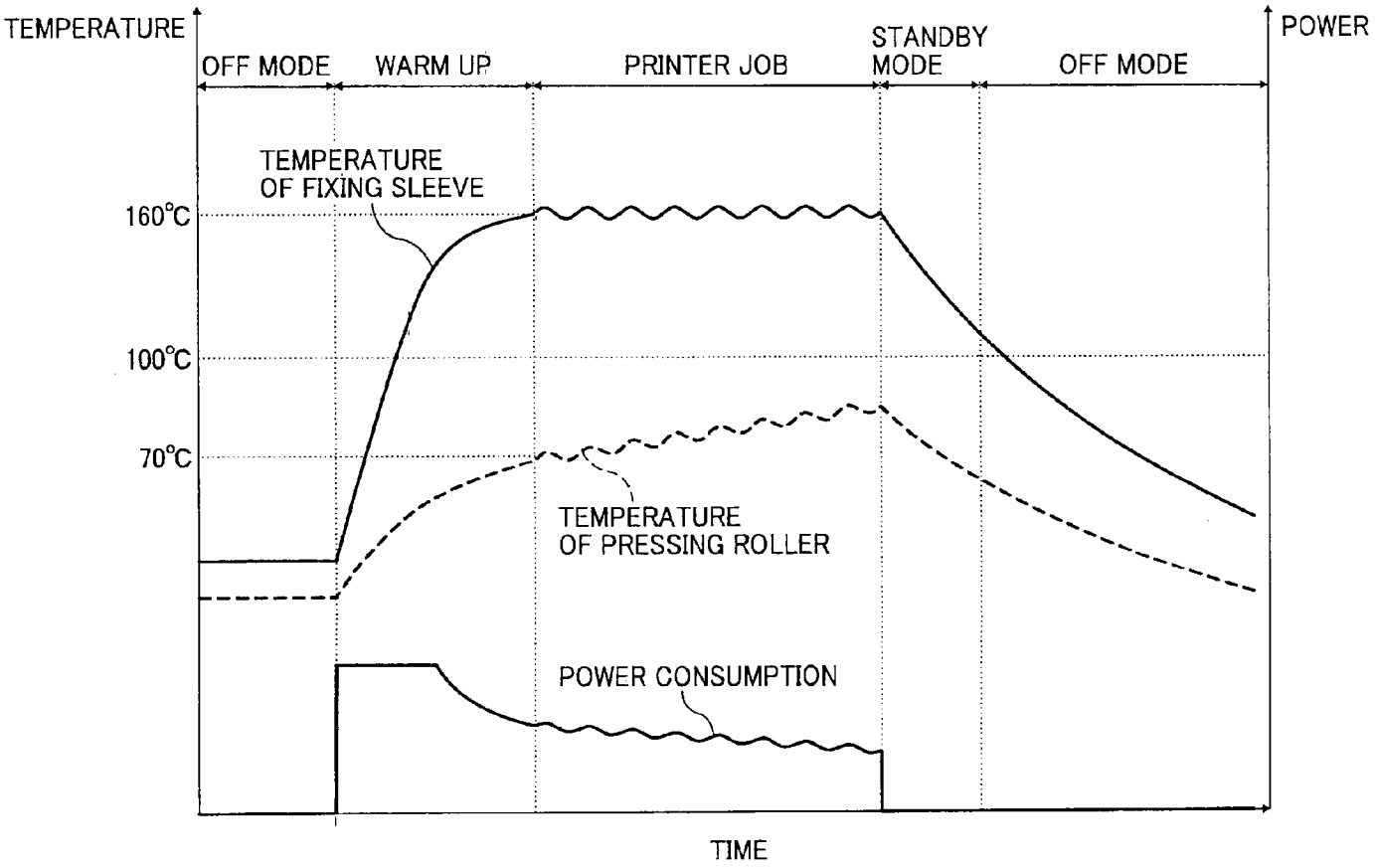
FIG. 3 is a graph showing a relation between a temperature of a fixing sleeve and a pressing roller included in the fixing device shown in FIG. 2 and power consumption over time when the image forming apparatus shown in FIG. 1 receives a printer job.

Referring to FIG. 3, a description is now given of control processes performed when the image forming apparatus 1 receives a printer job.

FIG. 3 is a graph showing a relation between the temperature of the fixing sleeve 22 and the pressing roller 23, on the one hand, and power consumption over time on the other when the image forming apparatus 1 receives a printer job.

A printer job starts when the controller 70 receives an instruction specified by the user using the control panel 71 of the image forming apparatus 1 or sent from an information processor (e.g., a client computer) connected to the image forming apparatus 1. Such instruction contains image data, a printing method, the number of pages to be printed, and so forth. The printer job ends when a recording medium P bearing a toner image T formed according to the instruction is discharged onto the output tray 3.

As illustrated in FIG. 3, the off mode is activated while the recording medium P is not conveyed in the image forming apparatus 1 to save energy.

Upon receipt of a printer job in the off mode, the fixing device 20 is warmed up. That is, the controller 70 controls the induction heater 30 to heat the fixing sleeve 22 to a predetermined target temperature.

For example, the induction heater 30 is supplied with power of up to 1,200 W to heat the fixing sleeve 22 and the fixing sleeve 22 heats the pressing roller 23 to about 70 degrees centigrade. When the temperature of the fixing sleeve 22 reaches about 160 degrees centigrade, the printer job starts, that is, the fixing device 20 starts conveying a recording medium P. During the printer job, the temperature of the fixing sleeve 22 is maintained at about 160 degrees centigrade. The temperature of the pressing roller 23 is maintained in a range of from about 70 degrees centigrade to about 90 degrees centigrade by heat conduction from the fixing sleeve 22.

When a last recording medium P of the printer job is discharged from the fixing nip N of the fixing device 20, the controller 70 performs a transition process to transit to the off mode. That is, the controller 70 notifies the fixing device 20 about 10 seconds later to enter the off mode. The fixing device 20 is configured to enter the standby mode after the printer job is finished. Also, the fixing device 20 is configured to enter the off mode if the fixing device 20 receives a signal to enter the off mode from the controller 70. Therefore, a time for which the fixing device 20 is in the standby mode is equal to a time required for the fixing device 20 to receive the signal to enter the off mode from the controller 70 after the printer job is finished.

As shown in FIG. 3, the pressing roller 23 is at a temperature in a range of from about 70 degrees centigrade to about 90 degrees centigrade during the printer job. Conventionally, in the standby mode, the induction heater 30 is not supplied with power but the pressing roller heater 40 is turned on to maintain the temperature of the pressing roller 23 at a target temperature (e.g., about 100 degrees centigrade) higher than a temperature of the pressing roller 23 during the printer job, thus shortening a time required to warm up the fixing device 20 before starting a next printer job.

However, when the printer job is finished, the pressing roller 23 is at a temperature in a range of from about 70 degrees centigrade to about 90 degrees centigrade, that is, at a temperature lower than the target temperature of about 100 degrees centigrade in the standby mode. Accordingly, after the printer job is finished, the controller 70 supplies maximum power having a duty ratio of 100 percent to the pressing roller heater 40 until the temperature of the pressing roller 23 reaches the target temperature, wasting energy.

To address this problem, with the configuration of the fixing device 20 according to this exemplary embodiment, if a job is a printer job, the controller 70 does not determine whether to enter the off mode soon (e.g., about 10 seconds) after the printer job is finished or to maintain the standby mode for a predetermined time period. Instead, the controller 70 turns off the pressing roller heater 40 for about 10 seconds after entering the standby mode regardless of a differential between the temperature of the pressing roller 23 and the target temperature, thus saving energy before entering the off mode. Since the fixing device 20 receives the signal to enter the off mode from the controller 70 about 10 seconds after the printer job is finished as described above, the fixing device 20 enters the off mode while the pressing roller heater 40 is turned off.

Figure 4:
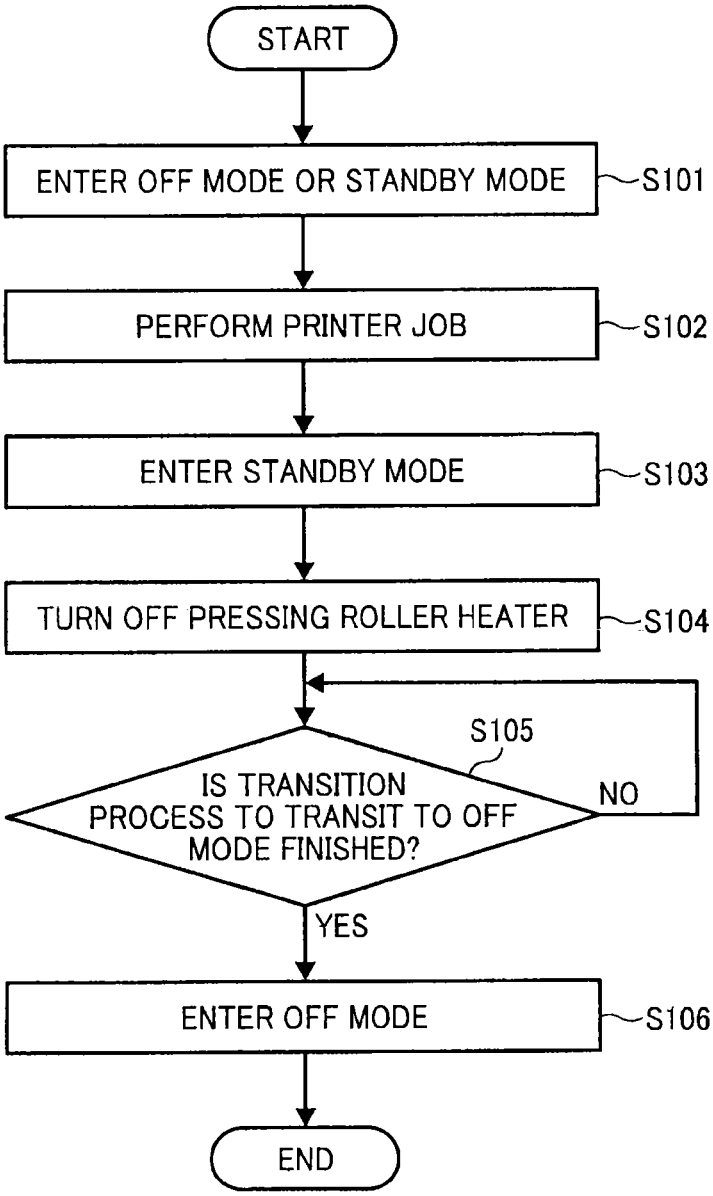
FIG. 4 is a flowchart showing control processes shown in FIG. 3.

Referring to FIG. 4, a description is now given of the control processes described above. FIG. 4 is a flowchart showing the control processes performed by the fixing device 20.

In step S101, the fixing device 20 enters the off mode or the standby mode. When the image forming apparatus 1 receives a printer job, the fixing device 20 is warmed up and performs the printer job in step S102. For example, the pressing roller 23 and the fixing roller 27 are rotated and the pressing roller heater 40 and the induction heater 30 are turned on to heat the pressing roller 23 and the fixing roller 27, respectively. Then, a recording medium P bearing a toner image T is conveyed through the fixing nip N.

As soon as the printer job is finished, the fixing device 20 enters the standby mode in which the induction heater 30 is turned off while the fixing roller 27 and the pressing roller 23 are not rotated in step S103. Simultaneously, the pressing roller heater 40 is turned off in step S104.

In step S105, the controller 70 determines whether the transition process to transit to the off mode is finished or not. If the fixing device 20 receives a signal to enter the off mode from the controller 70, that is, a signal notifying the fixing device 20 that the transition process to transit to the off mode is finished (YES in step S105), the fixing device 20 enters the off mode in step S106.

Figure 5:
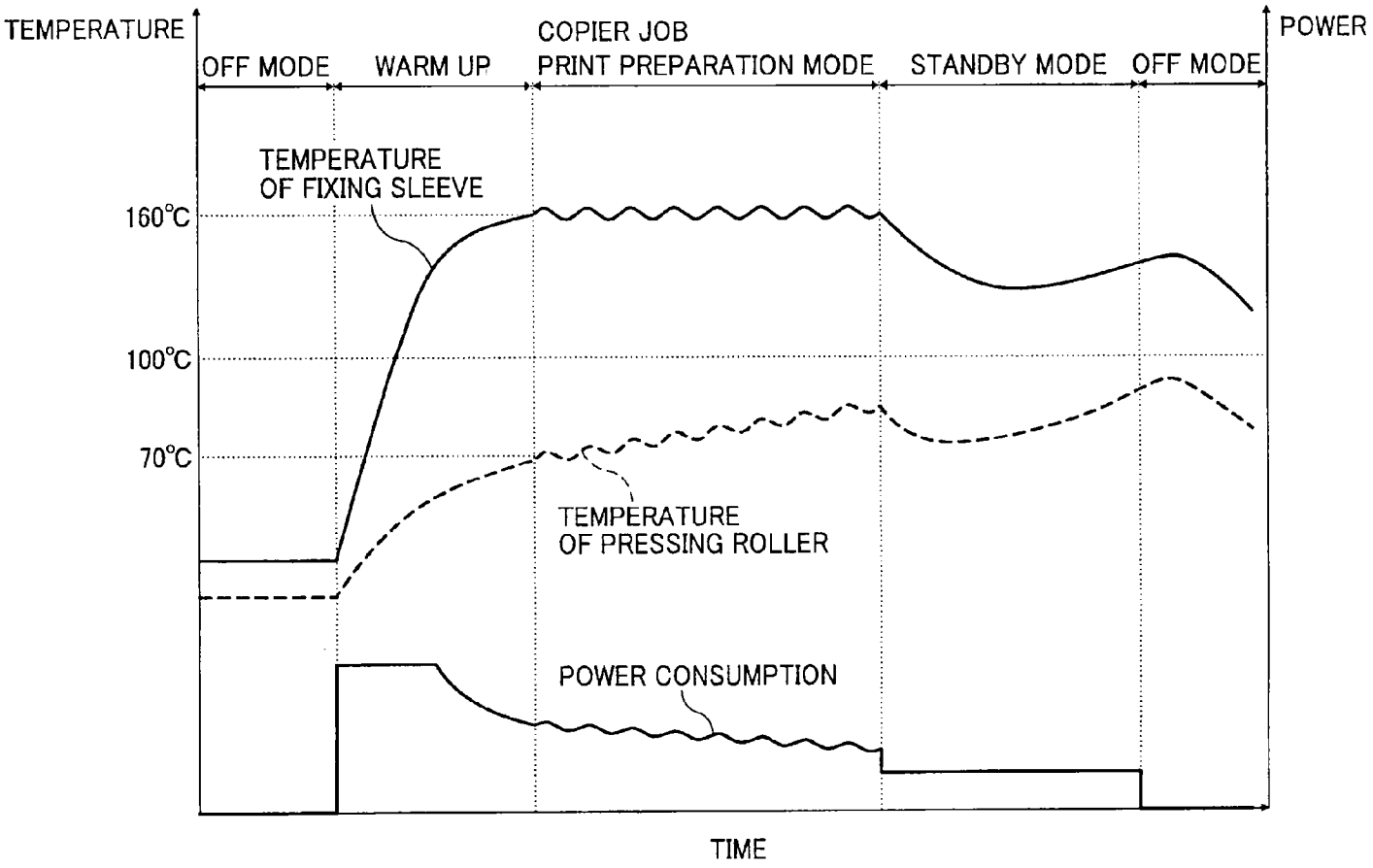
FIG. 5 is a graph showing a relation between the temperature of the fixing sleeve and the pressing roller and power consumption over time when the image forming apparatus receives a copier job or when the image forming apparatus is in a print preparation mode.

Referring to FIG. 5, a description is now given of control processes performed when the image forming apparatus 1 receives a copier job.

When the copier job is finished, the fixing device 20 enters the standby mode in which the pressing roller heater 40 is turned on to heat the pressing roller 23 while the fixing roller 27 and the pressing roller 23 are not rotated.

FIG. 5 is a graph showing a relation between the temperature of the fixing sleeve 22 and the pressing roller 23, on the one hand, and power consumption over time on the other when the image forming apparatus 1 receives a copier job or when the image forming apparatus 1 is in the print preparation mode in which at least one of the control panel 71, the reader 4, and the paper tray 7 is in operation and power is supplied to at least one of the induction heater 30 and the pressing roller heater 40 while at least one of the fixing roller 27 and the pressing roller 23 is rotated. When the copier job is finished, unlike when the printer job is finished, the user standing in front of the image forming apparatus 1 may continue inputting another copier job.

Therefore, if the image forming apparatus 1 enters the off mode immediately after the copier job is finished, it takes longer to warm up the fixing device 20 upon receipt of a next copier job, degrading usability of the image forming apparatus 1. To address this problem, when the copier job is finished, unlike when the printer job is finished, the controller 70 controls the fixing device 20 to maintain the standby mode for a longer time (e.g., about 60 seconds). Unless the user operates the image forming apparatus 1, for example, unless the user inputs the next copier job, within the longer standby time, the image forming apparatus 1 enters the off mode.

For example, according to this exemplary embodiment, immediately after the fixing device 20 enters the standby mode after the copier job is finished, the pressing roller heater 40 remains on throughout the standby mode to maintain the temperature of the pressing roller 23 at a target temperature, for example, at about 100 degrees centigrade.

Unless the user operates the image forming apparatus 1, for example, unless the user inputs the next copier job, during the standby mode, the fixing device 20 then enters the off mode to turn off the pressing roller heater 40.

Figure 6:
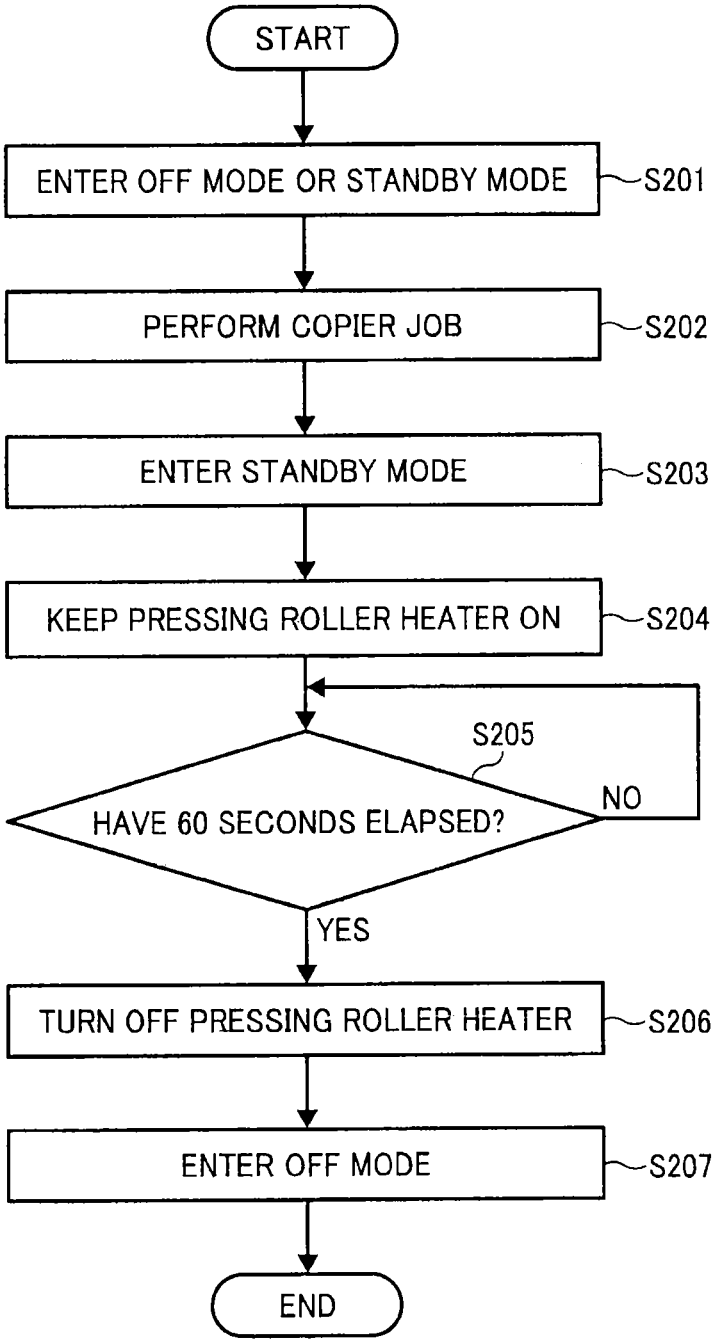
FIG. 6 is a flowchart showing control processes when the image forming apparatus receives the copier job shown in FIG. 5.

Referring to FIG. 6, a description is now given of the control processes described above.

FIG. 6 is a flowchart showing the control processes performed by the fixing device 20.

In step S201, the fixing device 20 enters the off mode or the standby mode. When the image forming apparatus 1 receives a copier job, the fixing device 20 is warmed up and performs the copier job in step S202. For example, the pressing roller 23 and the fixing roller 27 are rotated and the pressing roller heater 40 and the induction heater 30 are turned on to heat the pressing roller 23 and the fixing roller 27, respectively. Then, a recording medium P bearing a toner image T is conveyed through the fixing nip N.

As soon as the copier job is finished, the fixing device 20 enters the standby mode in which the induction heater 30 is turned off while the fixing roller 27 and the pressing roller 23 are not rotated in step S203. Simultaneously, the pressing roller heater 40 remains on in step S204.

In step S205, the controller 70 determines whether or not about 60 seconds have elapsed after the fixing device 20 enters the standby mode. If the controller 70 determines that about 60 seconds have elapsed without further operation of the user, for example, without receiving the next copier job (YES in step S205), the pressing roller heater 40 is turned off in step S206. Thereafter, the fixing device 20 enters the off mode in step S207.

Referring once again to FIG. 5, a description is now given of control processes performed to transit from the print preparation mode to the standby mode.

According to this exemplary embodiment, in the print preparation mode, the induction heater 30 heats the fixing sleeve 22 to maintain the temperature of the fixing sleeve 22 at a temperature near a target fixing temperature to fix the toner image T on the recording medium P.

The print preparation mode is activated when at least one of the control panel 71, the reader 4, and the paper tray 7 is in operation, that is, when the user operates the image forming apparatus 1, as described above. Accordingly, if the image forming apparatus 1 enters the off mode immediately after the print preparation mode is finished, it takes longer to warm up the fixing device 20 upon receipt of the next copier job, degrading usability of the image forming apparatus 1.

To address this problem, before entering the off mode after the print preparation mode, as when the copier job is finished, the controller 70 controls the fixing device 20 to maintain the standby mode for a longer time (e.g., about 60 seconds). Unless the user operates the image forming apparatus 1, for example, unless the user inputs the next copier job, within the longer standby time, the fixing device 20 then enters the off mode. It is to be noted that the standby time used for transition from the print preparation mode to the off mode may be different from the above-described standby time used for transition from the copier job to the off mode.

For example, according to this exemplary embodiment, immediately after the fixing device 20 enters the standby mode after the print preparation mode is finished, the pressing roller heater 40 remains on throughout the standby mode to maintain the temperature of the pressing roller 23 at a target temperature, for example, at about 100 degrees centigrade. Unless the user operates the image forming apparatus 1, for example, unless the user inputs the next copier job, during the standby mode, the fixing device 20 then enters the off mode to turn off the pressing roller heater 40.

Figure 7:
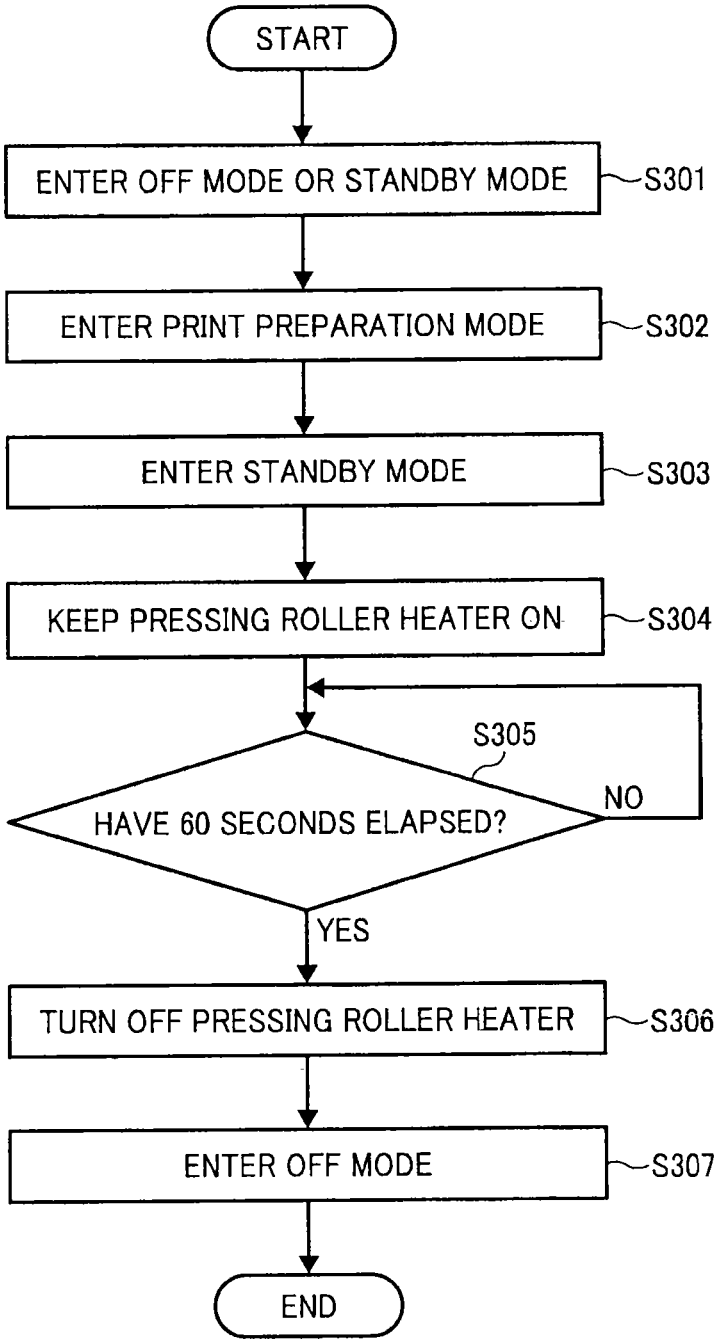
FIG. 7 is a flowchart showing control processes when the image forming apparatus is in the print preparation mode shown in FIG. 5.

Referring to FIG. 7, a description is now given of the control processes described above.

FIG. 7 is a flowchart showing the control processes performed by the fixing device 20.

In step S301, the fixing device 20 enters the off mode or the standby mode. Then, the fixing device 20 is warmed up and enters the print preparation mode in step S302. For example, the pressing roller 23 and the fixing roller 27 are rotated and the pressing roller heater 40 and the induction heater 30 are turned on to heat the pressing roller 23 and the fixing roller 27, respectively. Then, a recording medium P bearing a toner image T is conveyed through the fixing nip N. Thereafter, the fixing device 20 enters the standby mode in which the induction heater 30 is turned off while the fixing roller 27 and the pressing roller 23 are not rotated in step S303 and the controller 70 keeps the pressing roller heater 40 on in step S304.

In step S305, the controller 70 determines whether or not about 60 seconds have elapsed after the fixing device 20 enters the standby mode. If the controller 70 determines that about 60 seconds have elapsed without further operation of the user, for example, without receiving the next copier job (YES in step S305), the pressing roller heater 40 is turned off in step S306. Thereafter, the fixing device 20 enters the off mode in step S307.

With the configuration of the fixing device 20 according to the above-described exemplary embodiments, as the image forming apparatus 1 receives a printer job and the fixing device 20 enters the standby mode after the printer job is finished, the controller 70 turns off the pressing roller heater 40 during the standby mode, saving energy before the fixing device 20 enters the off mode after the printer job is finished.

According to the exemplary embodiment shown in FIG. 3, the standby mode that starts when the printer job is finished and ends when the controller 70 notifies the fixing device 20 to enter the off mode lasts for about 10 seconds. The pressing roller heater 40 is turned off for about 10 seconds. Alternatively, the pressing roller heater 40 need not be turned off throughout the standby mode, and instead, for example, the pressing roller heater 40 may be turned off only for a predetermined time period during the standby mode and may be turned on for another predetermined time period, that is, for several seconds after the fixing device 20 enters the standby mode.

Referring to FIGS. 8 to 11, the following describes other exemplary embodiments of the image forming apparatus 1. Structures and configurations identical to those of the above-described exemplary embodiments are omitted.

A description is now given of a second embodiment of the fixing device 20.

Figure 8:
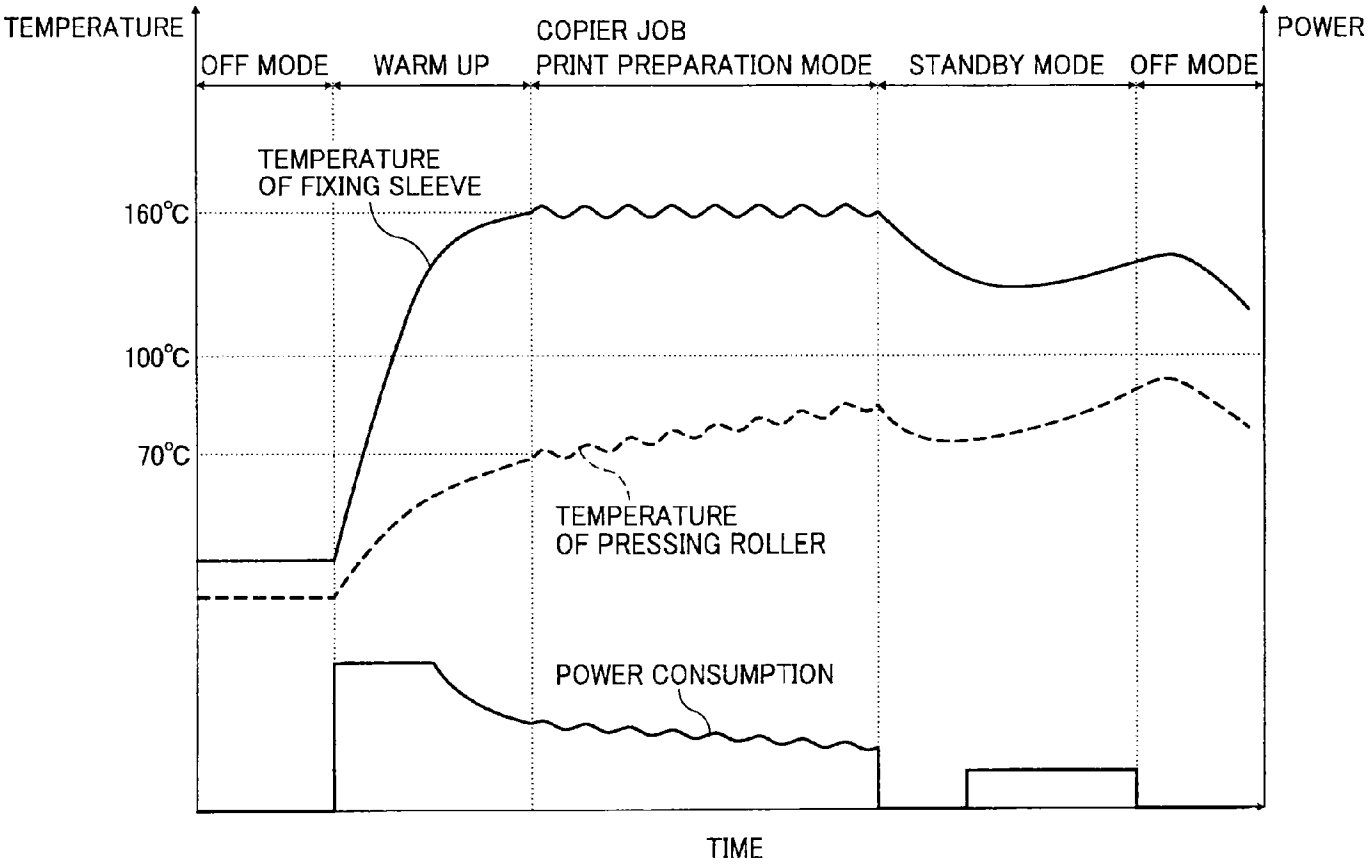
FIG. 8 is a graph showing another relation between the temperature of the fixing sleeve and the pressing roller and power consumption over time when the image forming apparatus receives a copier job or when the image forming apparatus is in the print preparation mode.

FIG. 8 is a graph showing a relation between the temperature of the fixing sleeve 22 and the pressing roller 23, on the one hand, and power consumption over time on the other when the image forming apparatus 1 receives a copier job or when the image forming apparatus 1 is in the print preparation mode.

According the first embodiment shown in FIG. 5, in the standby mode after the copier job or the print preparation mode is finished, the pressing roller heater 40 remains on. By contrast, according to the second embodiment shown in FIG. 8, even in the standby mode after the copier job or the print preparation mode is finished, like in the standby mode shown in FIG. 3 after the printer job is finished, the pressing roller heater 40 is turned off for a predetermined time period immediately after the fixing device 20 enters the standby mode, preferably for a predetermined time period equivalent to that set for the standby mode after the printer job is finished.

That is, the fixing device 20 according to the second embodiment need not determine whether or not to enter the off mode about 10 seconds after the copier job or the print preparation mode is finished, and thus does not require a determination function of the controller 70 that makes such determination. For example, for about 10 seconds after the fixing device 20 enters the standby mode, the pressing roller heater 40 is automatically turned off regardless of the job and the temperature of the pressing roller 23 and the fixing device 20.

As described above, after the copier job or the print preparation mode is finished, the standby mode lasts for about 60 seconds. Therefore, the pressing roller heater 40 is turned off immediately after the fixing device 20 enters the standby mode. Then, about 10 seconds later, the pressing roller heater 40 is turned on to heat the pressing roller 23 to a target temperature. When about 60 seconds elapse after the fixing device 20 enters the standby mode, the fixing device 20 receives a signal to enter the off mode from the controller 70. Accordingly, the pressing roller heater 40 is turned off and the fixing device 20 enters the off mode.

With the above-described control processes of the second embodiment, even if the pressing roller heater 40 is turned off for about 10 seconds in the standby mode, the fixing roller 27 and the pressing roller 23 store heat sufficiently and it does not take a longer time to start the next job, thus minimizing adverse effects.

Figure 9:
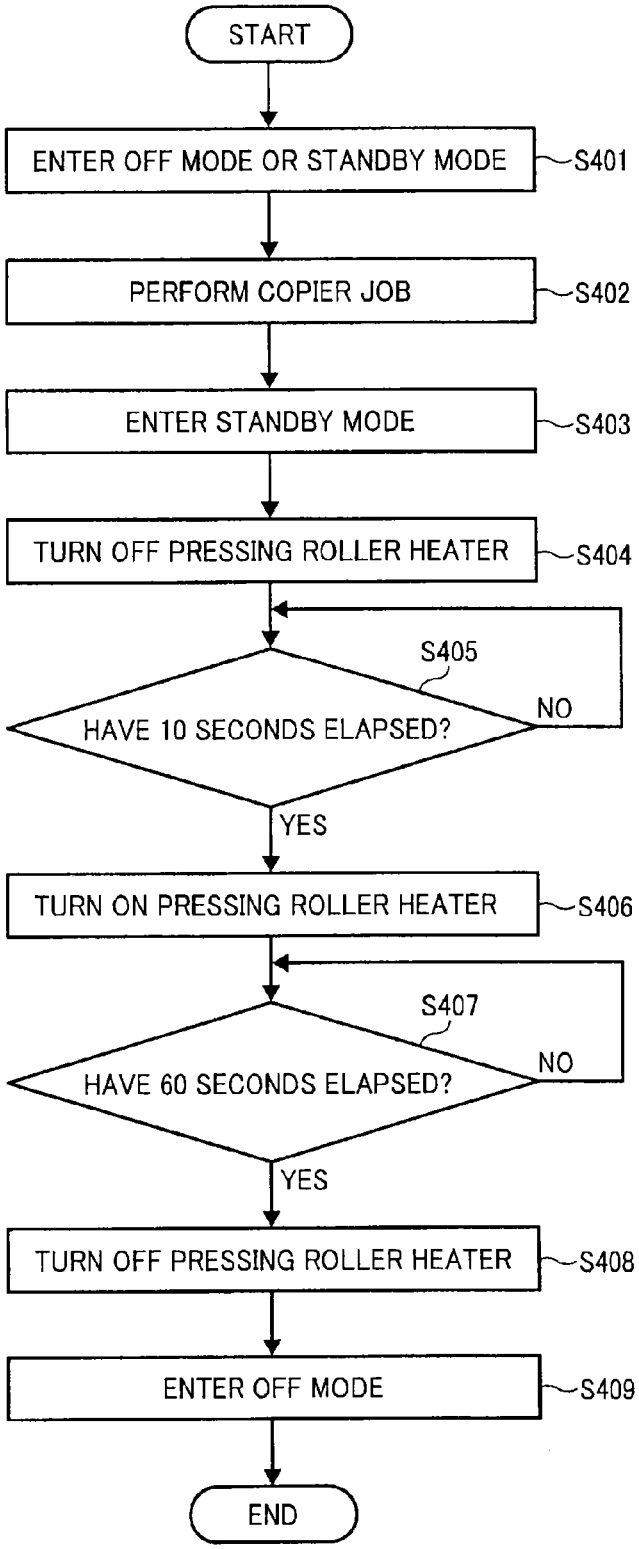
FIG. 9 is a flowchart showing control processes when the image forming apparatus receives the copier job shown in FIG. 8.
Figure 10:
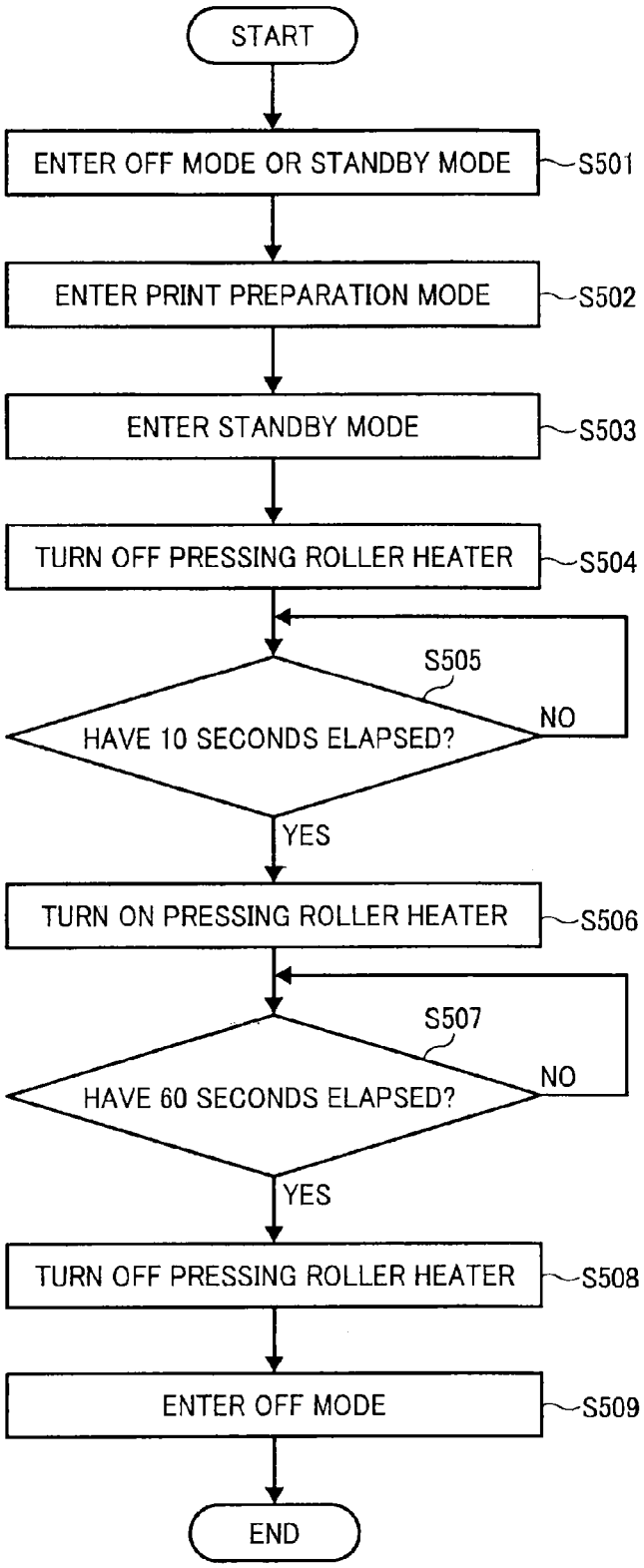
FIG. 10 is a flowchart showing control processes when the image forming apparatus is in the print preparation mode shown in FIG. 8.

Referring to FIGS. 9 and 10, a description is now given of the control processes described above. FIGS. 9 and 10 illustrate a flowchart showing the control processes performed by the fixing device 20.

In steps S401 and S501, the fixing device 20 enters the off mode or the standby mode. When the image forming apparatus 1 receives a copier job, the fixing device 20 is warmed up and performs the copier job in step S402. For example, the pressing roller 23 and the fixing roller 27 are rotated and the pressing roller heater 40 and the induction heater 30 are turned on to heat the pressing roller 23 and the fixing roller 27, respectively. Then, a recording medium P bearing a toner image T is conveyed through the fixing nip N. When the image forming apparatus 1 receives an instruction to enter the print preparation mode, the fixing device 20 enters the print preparation mode in which the induction heater 30 and the pressing roller heater 40 heat the rotating fixing roller 27 and the rotating pressing roller 23, respectively, in step S502.

As soon as the copier job or the print preparation mode is finished, the fixing device 20 enters the standby mode in which the induction heater 30 is turned off while the fixing roller 27 and the pressing roller 23 are not rotated in steps S403 and S503. Simultaneously, the pressing roller heater 40 is turned off for about 10 seconds immediately after the fixing device 20 enters the standby mode in steps S404 and S504.

In steps S405 and S505, the controller 70 determines whether about 10 seconds have elapsed or not. If the controller 70 determines that about 10 seconds have elapsed (YES in steps S405 and S505), the pressing roller heater 40 is turned on in steps S406 and S06.

In steps S407 and S507, the controller 70 determines whether about 60 seconds have elapsed or not after the fixing device 20 enters the standby mode. If the controller 70 determines that about 60 seconds have elapsed without operation of the user, for example, without receiving the next job (YES in steps S407 and S507), the pressing roller heater 40 is turned off again in steps S408 and S508. Thereafter, the fixing device 20 enters the off mode in steps S409 and S509.

With the above-described control processes of the fixing device 20 according to the second embodiment, the pressing roller heater 40 is turned off for a predetermined time period after the fixing device 20 enters the standby mode. Accordingly, the fixing device 20 transits from the standby mode to the off mode without wasting energy. The pressing roller heater 40 is turned off only for the initial time in the standby mode. Therefore, the fixing device 20 stores heat sufficiently and thus quits the standby mode swiftly to start the next job.

The pressing roller heater 40 is turned off for a predetermined time period immediately after the fixing device 20 enters the standby mode, that is equivalent to a time (e.g., about 10 seconds) for which the pressing roller heater 40 is turned off after the printer job is finished. That is, the pressing roller heater 40 is turned off for the predetermined time period after the fixing device 20 enters the standby mode regardless of the type of a job (e.g., a printer job or a copier job), that is, whether to enter the off mode soon after the job is finished or to enter the off mode after the standby mode is maintained for the predetermined time period. Accordingly, a complex configuration in which the controller 70 determines whether to enter the off mode immediately after the job is finished or to maintain the standby mode for the predetermined time period is unnecessary, facilitating control of the fixing device 20.

According to the second embodiment, the pressing roller heater 40 is turned off for about 10 seconds immediately after the fixing device 20 enters the standby mode. Alternatively, the pressing roller heater 40 may be turned on for a predetermined time period (e.g., about 2 or 3 seconds) immediately after the fixing device 20 enters the standby mode, and then turned off for another predetermined time period (e.g., about 7 or 8 seconds).

The image forming apparatus 1 installed with the fixing device 20 having the above-described configuration provides the control processes described above. Even when the pressing roller heater 40 is turned off in the standby mode after the print preparation mode is finished, if the control panel 71, the reader 4, or the paper tray 7 is in operation, it is preferable that the controller 70 turns on the pressing roller heater 40 even before the predetermined time period for which the pressing roller heater 40 is turned off in the standby mode has elapsed.

Accordingly, even if the pressing roller heater 40 is configured to be turned off in the standby mode, usability of the image forming apparatus 1 is maintained.

The present invention is not limited to the details of exemplary embodiments described above, and various modifications and improvements are possible.

The above-described exemplary embodiments apply to the fixing device 20 that includes the fixing roll 21, the fixing sleeve 22, the pressing roller 23, and the induction heater 30 that heats the fixing sleeve 22. Alternatively, the above-described exemplary embodiments may also be applicable to fixing devices having other structures, for example, to a fixing device having a fixing belt serving as a fixing rotary body stretched over a fixing roller and a heating roller.

Figure 11:
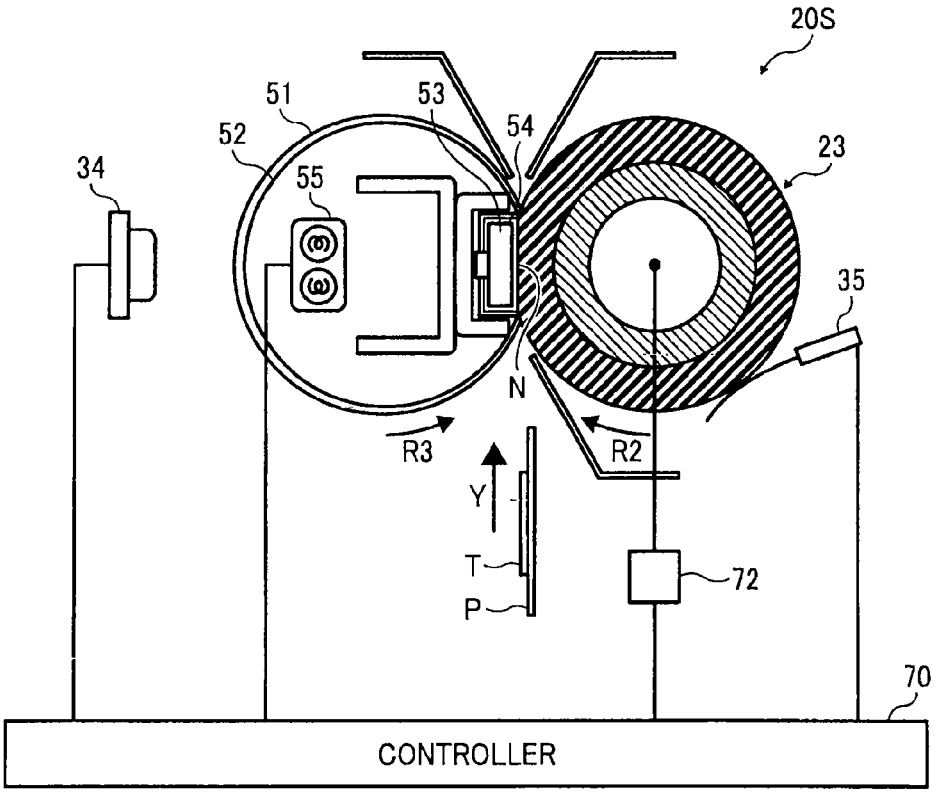
FIG. 11 is a vertical sectional view of a fixing device according to another exemplary embodiment of the present invention.

For example, the above-described exemplary embodiments may also be applied to a fixing device 20S having a fixing belt 51 serving as a fixing rotary body supported by a heat pipe 52 serving as a fixing rotary body heater as shown in FIG. 11. FIG. 11 is a vertical sectional view of the fixing device 20S. As illustrated in FIG. 11, the heat pipe 52 disposed inside a loop formed by the fixing belt 51 supports the fixing belt 51 at a portion of the fixing belt 51 other than the fixing nip N. At the fixing nip N, the pressing roller 23 is pressed against a nip forming pad 53 covered with a slide member 54 via the fixing belt 51. A halogen heater 55 disposed inside the loop formed by the fixing belt 51 heats the heat pipe 52 so that the heat pipe 52 heats the fixing belt 51. The pressing roller 23 rotates in the rotation direction R2. The fixing belt 51 rotates in the rotation direction R3 counter to the rotation direction R2 of the pressing roller 23 in such a manner that the fixing belt 51 slides over the slide member 54 covering the nip forming pad 53. As a recording medium P bearing a toner image T conveyed in a direction Y passes through the fixing nip N, the fixing belt 51 and the pressing roller 23 apply heat and pressure to the recording medium P, thus fixing the toner image T on the recording medium P.

The fixing device 20S does not have the pressing roller heater 40 depicted in FIG. 2 that heats the pressing roller 23. Accordingly, if the fixing belt 51 stops immediately after a job is finished, the fixing belt 51 is overheated by heat conduction from the heat pipe 52 having a temperature of about 200 degrees centigrade or higher due to absence of the recording medium P that draws heat from the fixing belt 51. To address this problem, the fixing belt 51 and the pressing roller 23 are rotated for a predetermined time period (e.g., 5 seconds) while the halogen heater 55 is turned off. After the fixing belt 51 is cooled, the fixing device 20S enters the standby mode in which the fixing belt 51 and the pressing roller 23 are stopped. The other control processes are equivalent to those of the fixing device 20 depicted in FIG. 2.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A method for forming a toner image on a recording medium, comprising:

receiving a printer job;

rotating a pressing rotary body in a predetermined direction of rotation;

rotating a flexible endless belt disposed opposite the pressing rotary body to form a nip therebetween in a direction counter to the direction of rotation of the pressing rotary body;

turning on a halogen heater disposed opposite an inner circumferential surface of the flexible endless belt to heat the flexible endless belt;

conveying the recording medium bearing the toner image through the nip;

turning off the halogen heater for a predetermined first time period after the recording medium is discharged from the nip while the flexible endless belt and the pressing rotary body rotate;

stopping the flexible endless belt and the pressing rotary body;

turning off the halogen heater for a predetermined second time period after stopping the flexible endless belt and the pressing rotary body regardless of a temperature of the flexible endless belt in a standby mode; and turning off the halogen heater in an off mode.

2. The method according to claim 1, further comprising:

activating a print preparation mode defining a state in which power is supplied to the halogen heater while at least one of the flexible endless belt and the pressing rotary body is rotated; and turning on the halogen heater to maintain a predetermined temperature of the flexible endless belt or higher for the predetermined second time period after conveying the recording medium bearing the toner image through the nip in the standby mode.

3. The method according to claim 2, further comprising turning off the halogen heater for the predetermined second time period in the standby mode at one of a time when receiving a copier job and a time when activating the print preparation mode.

4. The method according to claim 2, further comprising turning on the halogen heater for the predetermined second time period in the standby mode at one of a time when receiving a copier job and a time when activating the print preparation mode.

5. The method according to claim 2, further comprising:

turning off the halogen heater in the off mode at one of a time when receiving a signal to enter the off mode from a controller after activating the standby mode and a time when a predetermined operation is not performed in the standby mode to turn on the halogen heater for the predetermined second time period;

activating the off mode upon receipt of the signal to enter the off mode when receiving the printer job; and activating the off mode when the predetermined operation is not performed in the standby mode to turn on the halogen heater for the predetermined second time period at one of a time when receiving a copier job and a time when activating the print preparation mode.

6. The method according to claim 2, further comprising turning off the halogen heater for a predetermined third time period immediately after activating the standby mode to turn on the halogen heater for the predetermined second time period at one of a time when receiving a copier job and a time when activating the print preparation mode.

7. The method according to claim 6, wherein the predetermined third time period is equivalent to the predetermined second time period in the standby mode when receiving the printer job.

8. The method according to claim 2, further comprising turning on the halogen heater in the print preparation mode while turning off the halogen heater in the standby mode when one of a control panel, a reader, and a media tray of an image forming apparatus is activated.

* * * * *